US007251842B1

(12) United States Patent
Chiang

(10) Patent No.: US 7,251,842 B1
(45) Date of Patent: Aug. 7, 2007

(54) SWIMMING GOGGLES

(76) Inventor: Herman Chiang, 11F-2 No. 634-9 Ching-Ping RD., Chung-Ho, Taipei Hsien (TW)

( * ) Notice: Subject to any disclaimer, the term of this patent is extended or adjusted under 35 U.S.C. 154(b) by 0 days.

(21) Appl. No.: 11/410,191

(22) Filed: Apr. 25, 2006

(30) Foreign Application Priority Data

Feb. 14, 2006 (TW) ..... 95202541 U

(51) Int. Cl.
*A61F 9/02* (2006.01)

(52) U.S. Cl. ..... 2/445; 2/452

(58) Field of Classification Search ..... 2/428, 2/452, 445, 443; 351/43
See application file for complete search history.

(56) References Cited

U.S. PATENT DOCUMENTS 6,832,394 B1 * 12/2004 Chiang ..... 2/428
6,961,965 B2 * 11/2005 Chiang ..... 2/445
2006/0059607 A1 * 3/2006 Chiang ..... 2/428

* cited by examiner

*Primary Examiner*—Katherine Moran
(74) *Attorney, Agent, or Firm*—Troxell Law Office, PLLC

(57) ABSTRACT

Swimming goggles have a left frame, a right frame, lenses received in the left frame and the right frame, and a strap device. The strap device includes buckles respectively assembled on the left frame and the right frame, and a head strap extending through the buckles and defining a plurality of stop-grooves therein. Each buckle includes a connecting base, a peg locking with the connecting base, and a pressing member. The connecting base defines an opening therein, a guiding post being formed on a side of the opening for movably receiving the head strap. An engaging wall is formed on the connecting base, and an engaging arm is formed on the engaging wall for assembling to the left frame and the right frame. A block is formed on the pressing member and extends through the opening when assembled.

12 Claims, 8 Drawing Sheets

SWIMMING GOGGLES

BACKGROUND OF THE INVENTION

1. Field of the Invention

The present invention relates to swimming goggles, and particularly to swimming goggles which have an easily-adjustable head strap and are conveniently used.

2. Related Art

In prior art, when worn, swimming goggles have to be taken down for manually drawing head strap along holes in adjusting buckles for positioning the head strap with desired length. The swimming goggles have to be taken up and down more than once to suit for the user. It is often troublesome to adjust the head straps appropriately for users. TW patent Nos. 91220914, 92216640, 93208471, 93208473, 9421182, and U.S. patent application Ser. Nos. 09/034,907, 10/420,850, 10/873,260 disclose some solutions to this issue. In general, swimming goggles of these solutions comprise pressing bars with blocks and head straps with stop-grooves. The head strap is adjustable when the stop-grooves disengage from the blocks.

However, in TW patent Nos. 91220914, 92216640 and U.S. patent application Ser. Nos. 09/034,907, 10/420,850, 10/873,260, after the head strap is adjusted, the pressing bars have to be pushed for returning to abut the stop-grooves of the head strap. Moreover, assembly is troublesome since there are so many adjusting components. In TW patent Nos. 93208471, 93208473, 9421182, the pressing bars can automatically return to abut the stop-grooves of the head strap after the head strap is adjusted. Nevertheless, assembly of adjusting components are complicated.

SUMMARY OF THE INVENTION

Accordingly, an object of the present invention is to provide swimming goggles which have easily-adjustable head strap and which are assembled simply and reliably.

Another object of the present invention is to provide swimming goggles which automatically drive the head strap to move in a single direction, in other words, the head strap automatically remain to be movable in a single direction tending to tighten after adjusted.

The swimming goggles comprise a left frame, a right frame, lenses, and a strap device. A nose support connects the left frame and the right frame. The left frame and the right frame respectively have front surfaces, rear surfaces, and outer surfaces. Receiving grooves are respectively defined between the front surfaces and the rear surfaces for receiving the lenses. Assembling holes are respectively defined through the front surfaces and the rear surfaces.

The strap device comprises buckles and a head strap extending through the buckles. The buckles are respectively assembled on the assembling holes of the left frame and the right frame. A plurality of stop-grooves is defined in the head strap. Each buckle includes a connecting base, a peg and a pressing member. The connecting base defines an opening therein, a guiding post being formed on a side of the opening. An engaging wall is formed on the connecting base and extends forwardly and far away from the guiding post. An engaging arm is formed on the engaging wall for corresponding to the assembling holes. Shaft blocks are respectively formed on a top and a bottom of the connecting base. The peg defines a locking hole for locking with the engaging arm. The pressing member forms shaft bases respectively at a top and a bottom thereof. Shaft holes are respectively defined in the shaft bases. A block is formed on the pressing member and extends through the opening when assembled.

In normal state, the blocks of the pressing members abut against the stop-grooves of the head straps. The head straps are movable only toward a direction tending to tighten. In the case that the pressing members are pulled to disengage the blocks from stop-grooves, the head straps are allowed to move in both directions tending to loosen and tighten.

DESCRIPTION OF THE PREFERRED EMBODIMENTS

Figure 1:
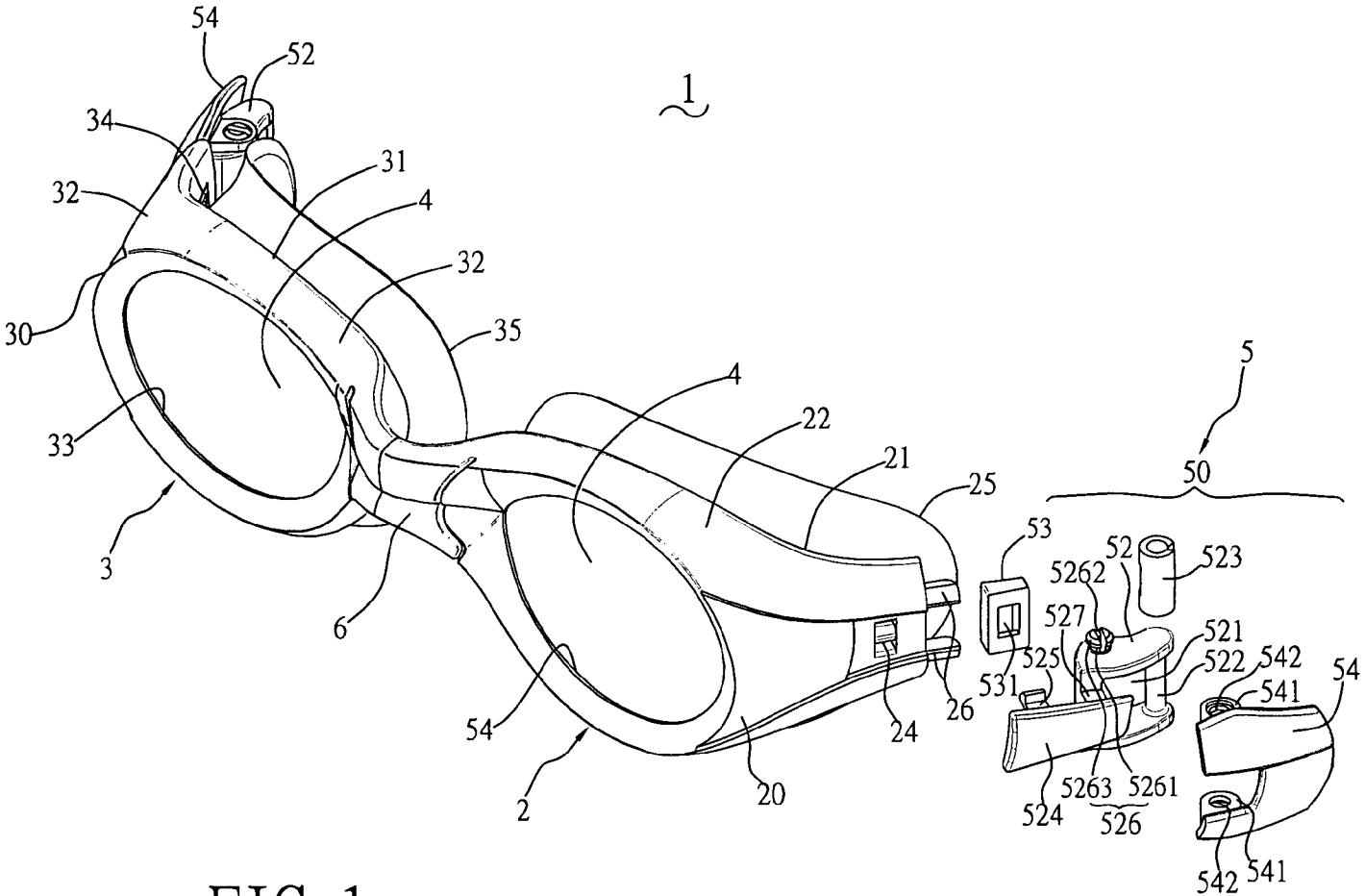
FIG. 1 is a perspective view of swimming goggles of the present invention, wherein a buckle thereof is exploded.
Figure 2:
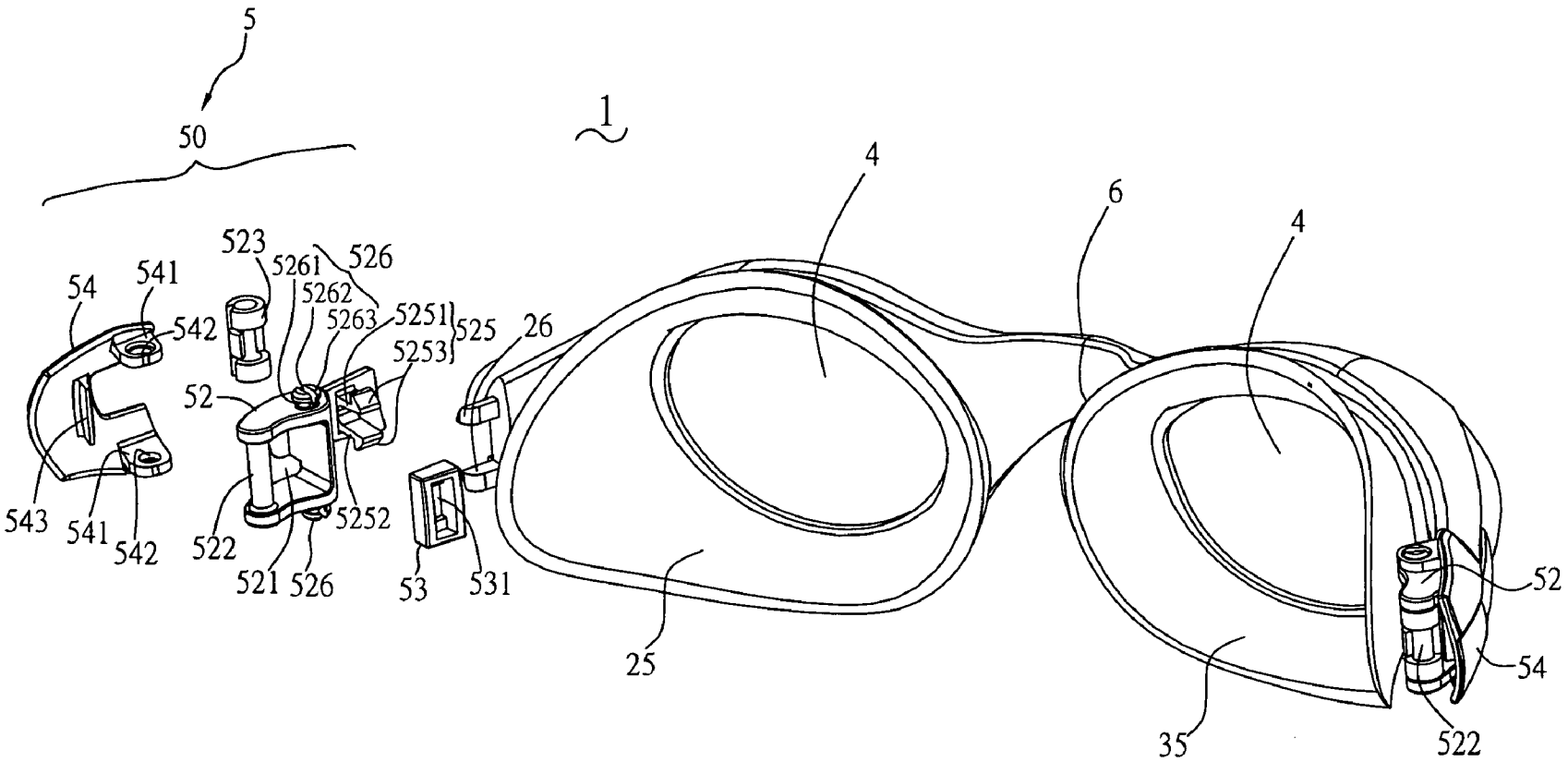
FIG. 2 is similar to FIG. 1, wherein the swimming goggles are placed upside down.

With reference to FIGS. 1 and 2, swimming goggles 1 of the present invention comprise a left frame 2, a right frame 3, two lenses 4 and a strap device 5. The left frame 2 and the right frame 3 are made of soft material, and are connected by a nose support 6. The left frame 2 and the right frame 3 respectively have front surfaces 20, 30, rear surfaces 21, 31, and outer surfaces 22, 32. Receiving grooves 23, 33 are respectively defined between the front surfaces 20, 30 and the rear surfaces 21, 31 for accommodating the lenses 4. Assembling holes 34, 34 are respectively defined through the front surfaces 20, 30 and the rear surfaces 21, 31 for assembling the strap device 5. Pads 25, 35 are unitarily formed with the rear surfaces 21, 31 for touching a user's face comfortably. Soft abutting surfaces 26 extend respectively from the left frame 2 and the right frame 3 for providing appropriate resiliency.

Figure 9A:
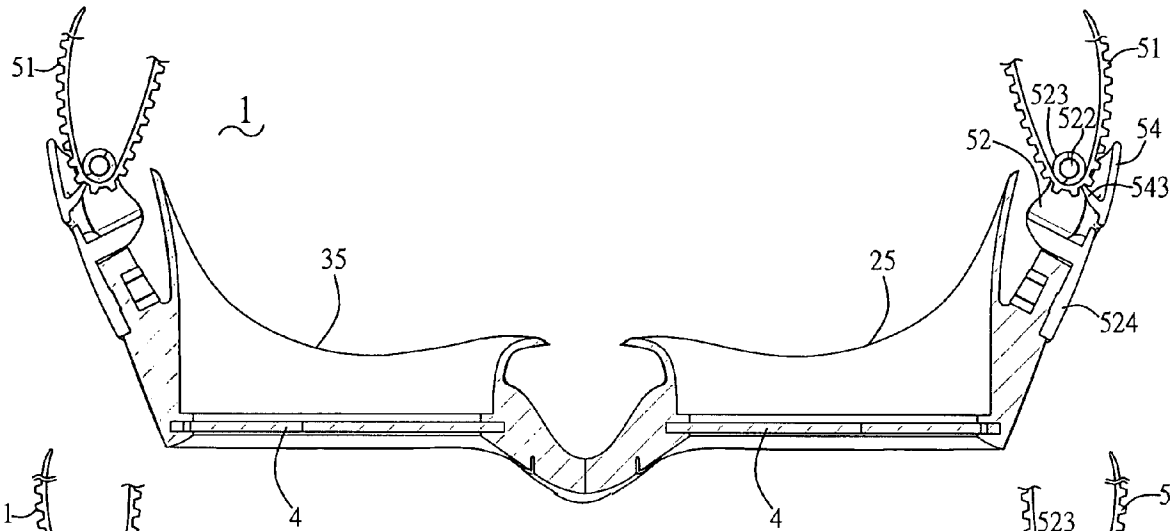
FIGS. 9A and 9B schematically show head straps of the swimming goggles being adjusted.
Figure 9B:
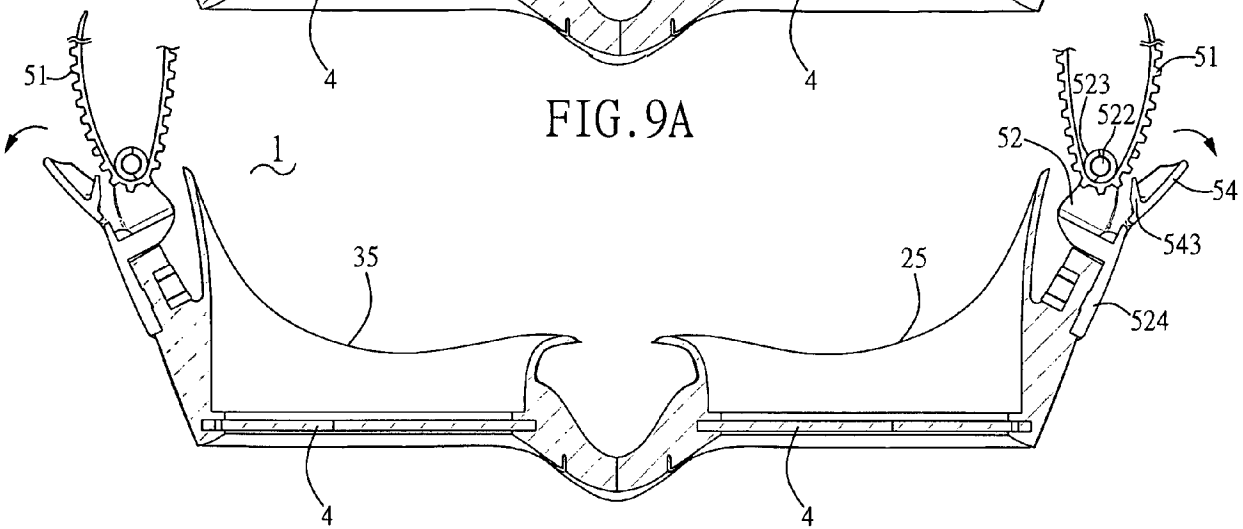

Further referring to FIGS. 9A and 9B, the strap device 5 includes buckles 50 and a head strap 51 extending through the buckles 50. The buckles 50 are respectively assembled on the assembling holes 24, 34 of the left frame 2 and the right frame 3. Each buckle 50 comprises a connecting base 52, a peg 53 and a pressing member 54. The connecting base 52 defines an opening 521 for movably receiving the head strap 51. A guiding post 522 is formed on a side of the opening 521. A sleeve 523 is mounted on the guiding post 522 for facilitating the head strap 51 to move. The sleeve 523 has an upper part, a lower part and a middle part reversely enveloping for simplifying assembly. An engaging wall 524 is formed on the connecting base 52 and extends forwardly and far away from the guiding post 522. An engaging arm 525 is formed on the engaging wall 524 for corresponding to the assembling holes 24, 34. The engaging arm 525 forms an upper flange 5251 extending slightly upwardly, and a lower flange 5252 extending slightly downwardly. Anchors 5253 are respectively formed on edges of the upper flange 5251 and the lower flange 5252. Shaft blocks 526 are respectively formed on a top and a bottom of the connecting base 52. Each shaft block 526 has a shaft rivet 5261, which forms an expanded end 5263 on a free end thereof and defines a slit 5262 in a center thereof for providing resiliency. An intermediate portion 527 is formed between the connecting base 52 and the engaging wall 524 for providing offset therebetween. The engaging walls 524 are shaped to correspond to the front surfaces 20, 30 of the left frame 2 and the right frame 3. For instance, outward surfaces of the engaging walls 524 are respectively aligned with the front surfaces 20, 30 of the left frame 2 and the right frame 3 properly.

Figure 5:
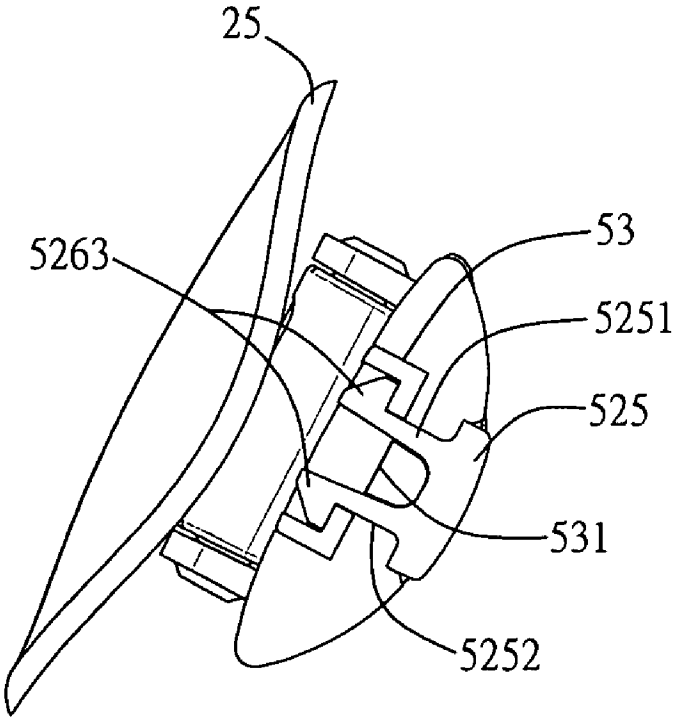
FIG. 5 is a cross-sectional view taken along the line 5-5 in FIG. 4.
Figure 8:
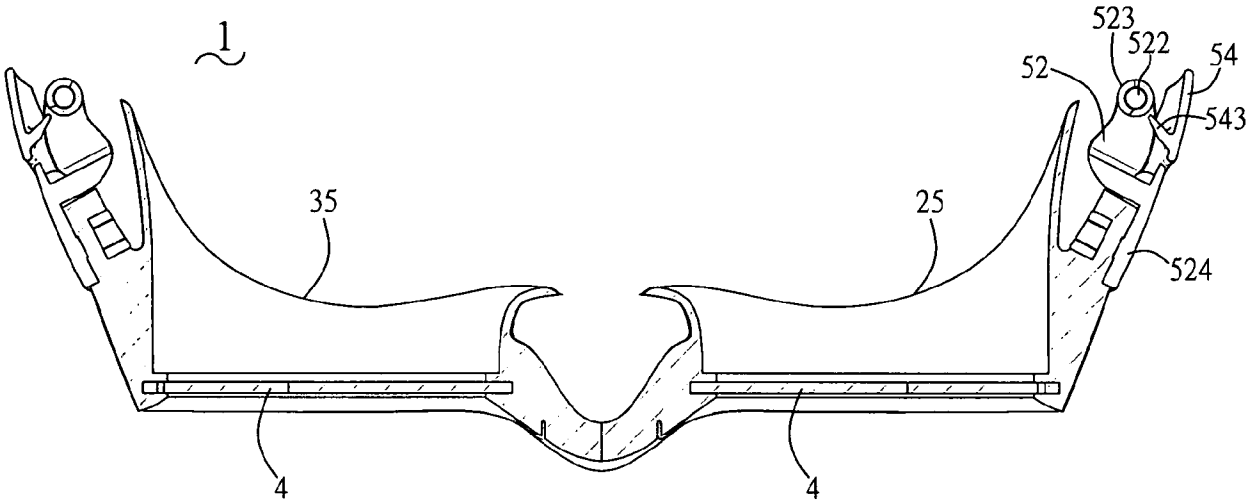
FIG. 8 is a cross-sectional view taken along the line 8-8 in FIG. 7.
Figure 7:
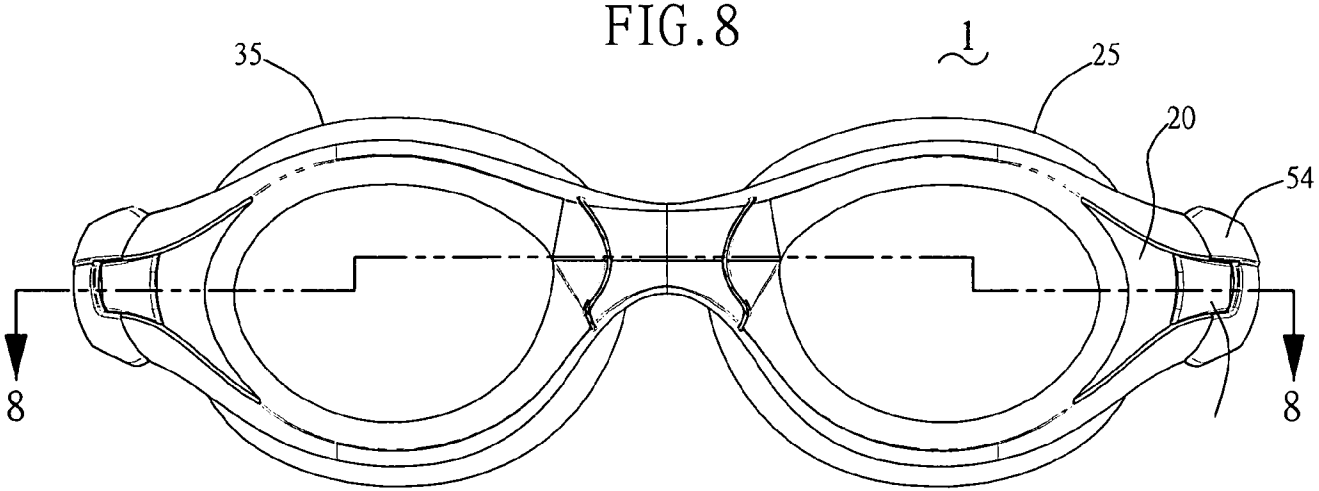
FIG. 7 is a front view of the swimming goggles of FIG. 3.

The peg 53 defines a locking hole 531 therein. The locking hole 531 has width smaller than width between ends of the upper flange 5251 and the lower flange 5252 of the engaging arm 525 for locking with the engaging arm 525 firmly. Referring to FIG. 5, when the upper flange 5251 and the lower flange 5252 are assembled on the peg 53, the anchors 5253 lock with the locking hole 531.

Figure 6:
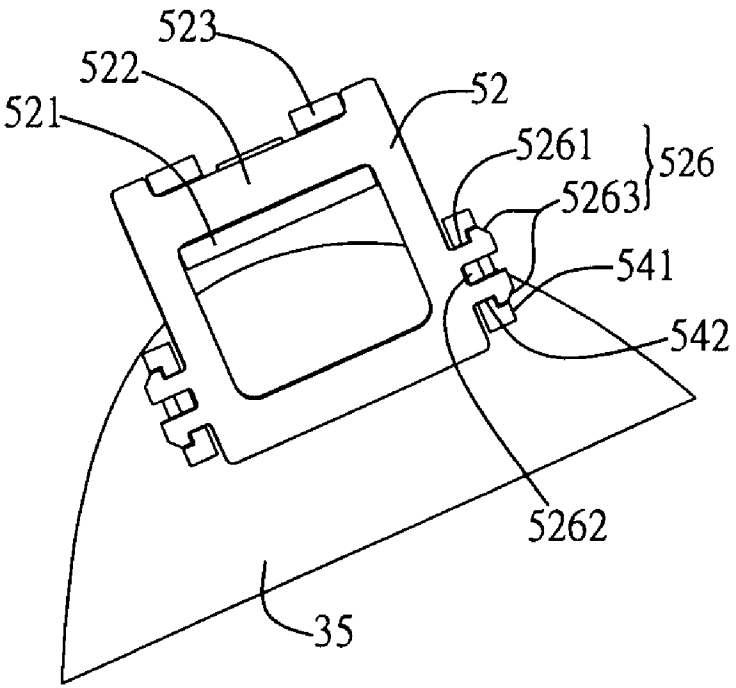
FIG. 6 is a cross-sectional view taken along the line 6-6 in FIG. 4.

The pressing member 54 respectively forms shaft bases 541 at a top and a bottom thereof. Shaft holes 542 are respectively formed on the shaft bases 541 and are aligned with each other and each of which is a sinking head slot for pivoting to the shaft block 526. Referring to FIG. 6, when the pressing member 54 is assembled on the connecting base 52, the expanded ends 5263 of the shaft rivets 5261 latch the shaft holes 542, whereby the pressing member 54 is assembled to the connecting base 52 retainedly. A block 543 is formed on the pressing member 54 and extends through the opening 521 when assembled for abutting against stop-grooves 510 (shown in FIGS. 9A and 9B) of the head strap 51. The pressing member 54 is shaped to fit for the engaging wall 524.

Combining with FIG. 9A, the head strap 51 defines a plurality of stop-grooves 510 spaced apart the same distance from each other. The stop-grooves 510 engage with the block 543, so the head strap 51 is movable only in a single direction. For example, the head strap 51 is movable only in a direction which tends to tighten.

Figure 3:
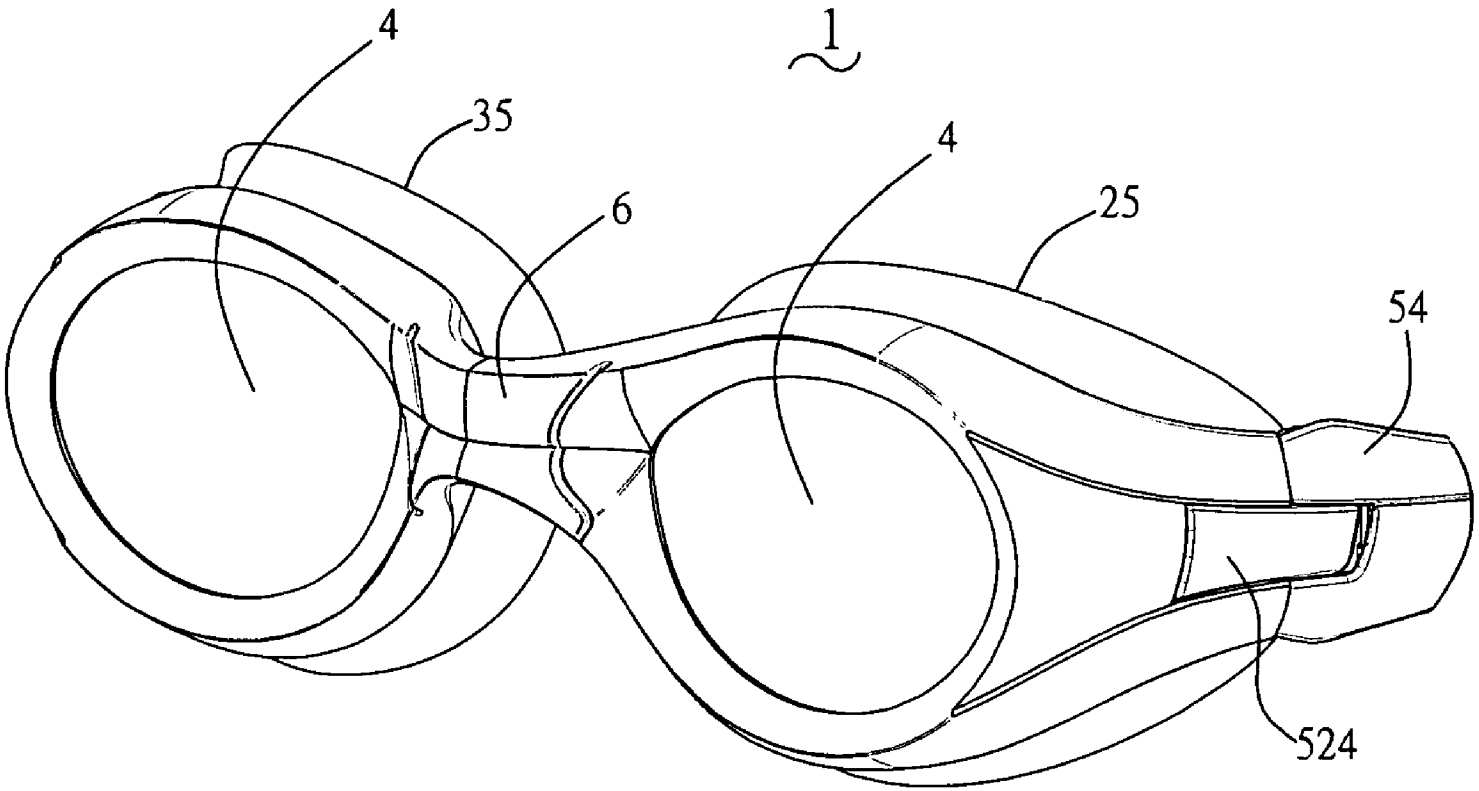
FIG. 3 is a perspective view of swimming goggles of the present invention.
Figure 4:
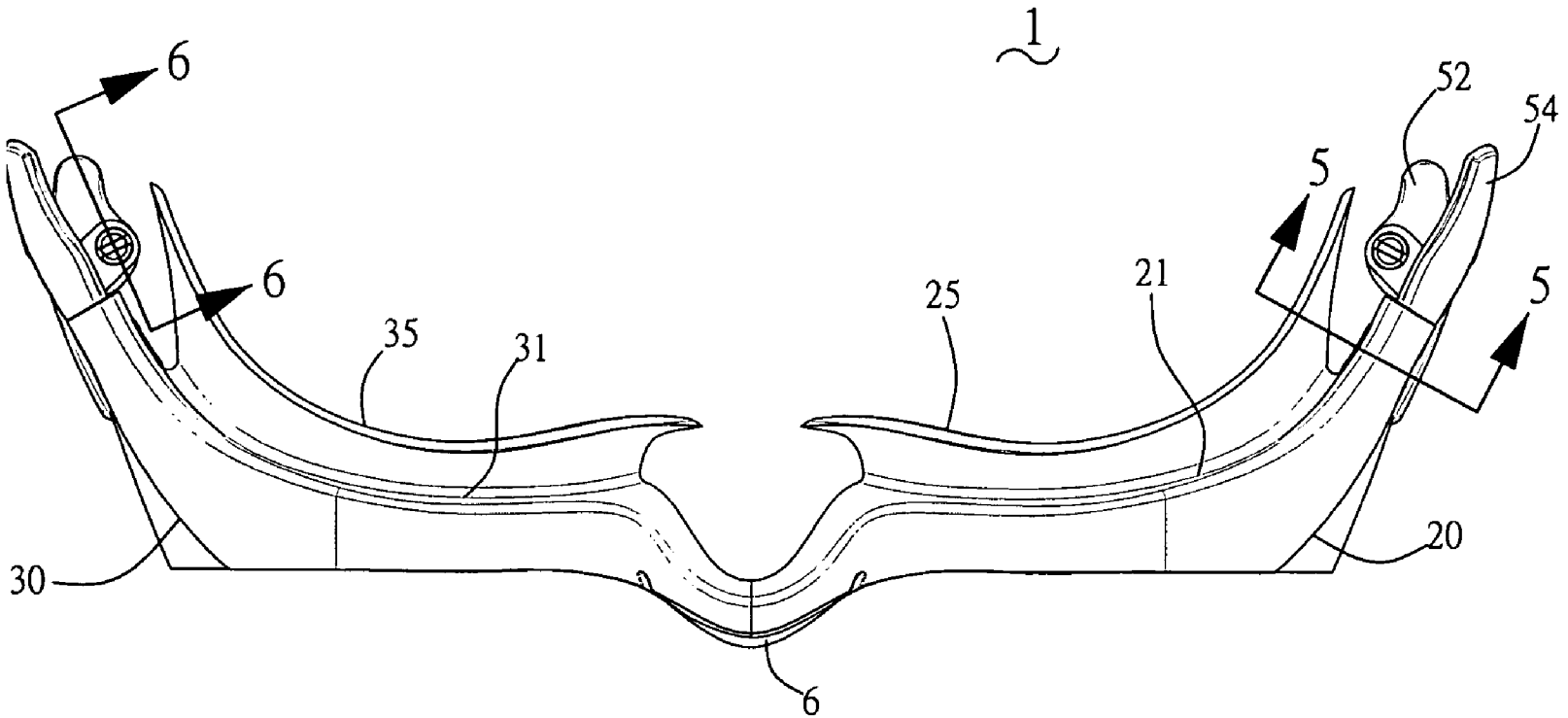
FIG. 4 is a top view of the swimming goggles of FIG. 3.

Referring to FIGS. 1-3, in assembly, the lenses 4 are respectively implanted to the receiving grooves 23, 33 of the left frame 2 and the right frame 3. Then the lenses 4 are incorporated with the left frame 2 and the right frame 3 by integrative shaping technology. The engaging arms 525 respectively engage with the assembling holes 24, 34. The locking holes 531 of the pegs 53 lock with the upper flanges 5251 and the lower flanges 5252 of the engaging arms 525, as shown in FIG. 5. The shaft holes 542 of the pressing members 54 engage with the shaft bases 526 of the connecting bases 52, as shown in FIG. 6. Finally the sleeves 523 are mounted on the guiding posts 522.

Figure 10:
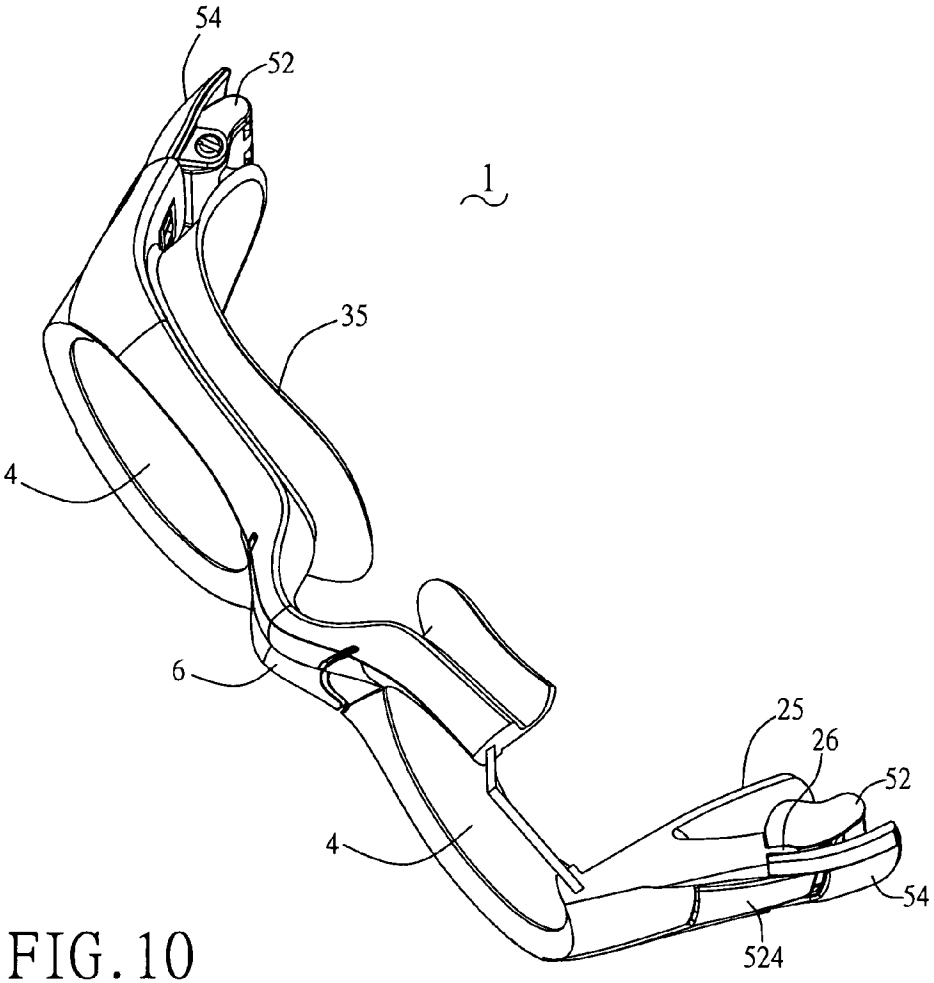
FIG. 10 is similar to FIG. 3, wherein parts of the swimming goggles are removed to clearly shown buckles thereof.

As shown in FIG. 9A, in normal state, the blocks 543 of the pressing members 54 abut against the stop-grooves 510 of the head strap 51. The head strap 51 is movable only toward a direction tending to tighten, while is prohibited to move toward a direction tending to loosen. As shown in FIG. 9B, when the swimming goggles 1 are worn, the pressing members 54 are pulled to disengage the blocks 543 from the stop-grooves 510. At this time the head strap 51 is allowed to move in both directions tending to loosen and tighten. Referring to FIG. 10, ends of the pressing members 54 bias the soft abutting surfaces 26. The pressing members 54 return automatically to abut against stop-grooves 510 of the head strap 51 again due to appropriate resiliency of the abutting surfaces 26. Thus the head strap 51 are easily adjusted without the need of taking the swimming goggles 1 down when the swimming goggles 1 are worn. Once the pressing members 54 are pulled, the head strap 51 is allowed to loosen. In the case of the pressing members 54 are released, the head strap 51 is stopped and is movable only in a direction tending to tighten. The swimming goggles 1 of the present invention have simple structure and are assembled simply and reliably. The pressing members 54 can automatically return, making the head strap 51 be adjusted more easily.

It is understood that the invention may be embodied in other forms without departing from the spirit thereof. Thus, the present examples and embodiments are to be considered in all respects as illustrative and not restrictive, and the invention is not to be limited to the details given herein.

I claim:

1. Swimming goggles comprising:

a left frame and a right frame being connected by a nose support, the left frame and the right frame respectively having front surfaces, rear surfaces, and outer surfaces, receiving grooves being respectively defined between the front surfaces and the rear surfaces, assembling holes being respectively defined through the front surfaces and the rear surfaces;

lenses received in the receiving grooves; and a strap device comprising buckles and a head strap extending through the buckles, a plurality of stop-grooves being defined in the head strap, the buckles being respectively assembled on the assembling holes of the left frame and the right frame, each buckle comprising:

a connecting base defining an opening therein, a guiding post being formed on a side of the opening, an engaging wall being formed on the connecting base and extending forwardly and far away from the guiding post, an engaging arm being formed on the engaging wall for corresponding to the assembling holes, shaft blocks being respectively formed on a top and a bottom of the connecting base;

a peg defining a locking hole for locking with the engaging arm; and a pressing member forming shaft bases respectively at a top and a bottom thereof, shaft holes being respectively defined in the shaft bases, a block being formed on the pressing member and extending through the opening when assembled.

2. The swimming goggles as claimed in claim 1, wherein each shaft block has a shaft rivet, which forms an expanded end on a free end thereof and defines a slit in a center thereof.

3. The swimming goggles as claimed in claim 2, wherein the shaft holes are respectively formed on the shaft bases and are aligned with each other and each of which is a sinking head slot for pivoting to the shaft block.

4. The swimming goggles as claimed in claim 3, wherein the engaging arm forms an upper flange extending slightly upwardly, and a lower flange extending slightly downwardly, and wherein anchors are respectively formed on edges of the upper flange and the lower flange.

5. The swimming goggles as claimed in claim 4, wherein the locking hole has a width smaller than the width between ends of the upper flange and the lower flange of the engaging arm.

6. The swimming goggles as claimed in claim 1, further comprising sleeves mounted on the guiding posts of the buckles.

7. The swimming goggles as claimed in claim 6, wherein each sleeve has an upper part, a lower part and a middle part reversely enveloping together.

8. The swimming goggles as claimed in claim 1, wherein the lenses are incorporated with the left frame and the right frame.

9. The swimming goggles as claimed in claim 1, wherein pads are unitarily formed with the left frame and the right frame.

10. The swimming goggles as claimed in claim 1, wherein an intermediate portion is formed between the connecting base and the engaging wall for providing offset therebetween.

11. The swimming goggles as claimed in claim 10, wherein soft abutting surfaces extend respectively from the left frame and the right frame for providing appropriate resiliency, the pressing members biasing the abutting surfaces when the pressing members are pulled, and the pressing members returning automatically when the pressing members are released due to appropriate resiliency of the abutting surfaces.

12. The swimming goggles as claimed in claim 1, wherein the engaging walls are shaped to correspond to the front surfaces of the left frame and the right frame, and wherein the pressing members are shaped to fit for the engaging walls.

* * * * *